US009513586B2

(12) United States Patent
Narahara et al.

(10) Patent No.: US 9,513,586 B2
(45) Date of Patent: Dec. 6, 2016

(54) IMAGE HEATING APPARATUS HAVING FILM, BACK-UP MEMBER FORMING A NIP WITH THE FILM, A HEATER, AND HEAT CONDUCTIVE MEMBERS CONFIGURED TO BE BROUGHT INTO CONTACT WITH HEATER SURFACE OPPOSITE TO THE SURFACE OF THE HEATER BROUGHT INTO CONTACT WITH THE FILM

(71) Applicant: CANON KABUSHIKI KAISHA, Tokyo (JP)

(72) Inventors: Takashi Narahara, Mishima (JP); Toru Imaizumi, Kawasaki (JP); Yasuhito Minamishima, Odawara (JP); Kenichi Ogawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/938,236

(22) Filed: Nov. 11, 2015

(65) Prior Publication Data

US 2016/0139551 A1 May 19, 2016

(30) Foreign Application Priority Data

Nov. 14, 2014 (JP) ..... 2014-231522

(51) Int. Cl.
*G03G 15/20* (2006.01)
*G03G 15/00* (2006.01)

(52) U.S. Cl.
CPC ..... *G03G 15/55* (2013.01); *G03G 15/2042* (2013.01); *G03G 15/2053* (2013.01); *G03G 2215/2035* (2013.01)

(58) Field of Classification Search
CPC ..... G03G 15/2046
See application file for complete search history.

(56) References Cited

U.S. PATENT DOCUMENTS 7,389,079 B2 6/2008 Narahara et al.
8,331,819 B2 12/2012 Fukuzawa et al.
(Continued)

FOREIGN PATENT DOCUMENTS

JP 05289555 A * 11/1993
JP 11-84919 A 9/1999
(Continued)

OTHER PUBLICATIONS

JP_05289555_A_T Machine Translation, Japan, Nov. 1993, Yamanaka.*

(Continued)

*Primary Examiner* — Minh Phan
*Assistant Examiner* — Victor Verbitsky
(74) *Attorney, Agent, or Firm* — Fitzpatrick, Cella, Harper & Scinto

(57) ABSTRACT

The image heating apparatus includes a tubular shaped film; a backup member configured to be brought into contact with an outer surface of the film; a heater having an elongated shape and being configured to be brought into contact with the film, the heater including a substrate and a heat generating resistor formed; a first heat conductive member having a higher thermal conductivity than the substrate and being configured to be brought into contact with a surface of the heater, the first heat conductive member including divided first heat conductive members arranged with a gap formed therebetween; a pinching member configured to pinch the first heat conductive member; and a second heat conductive member provided in a region of the gap so as to be brought into contact with both of the heater and the pinching member.

18 Claims, 12 Drawing Sheets

(56) References Cited

U.S. PATENT DOCUMENTS

| | | | |
|---|---|---|---|
| 8,364,067 | B2 | 1/2013 | Miki et al. |
| 8,532,530 | B2 | 9/2013 | Nishida et al. |
| 8,744,296 | B2 | 6/2014 | Fukuzawa et al. |
| 8,831,493 | B2 | 9/2014 | Tanaka et al. |
| 8,971,744 | B2 | 3/2015 | Nihonyanagi et al. |
| 9,229,388 | B2 | 1/2016 | Imaizumi et al. |
| 2003/0077092 | A1 | 4/2003 | Ogawa et al. |
| 2007/0182798 | A1* | 8/2007 | Makihira ..... G03G 15/2042 347/102 |
| 2014/0016972 | A1 | 1/2014 | Seshita et al. |
| 2015/0023704 | A1 | 1/2015 | Imaizumi et al. |
| 2015/0227091 | A1 | 8/2015 | Ando et al. |

FOREIGN PATENT DOCUMENTS

| | | | |
|---|---|---|---|
| JP | 2011-028081 | A | 2/2011 |
| JP | 2014-032389 | A | 2/2014 |
| JP | 2014-123100 | A | 7/2014 |

OTHER PUBLICATIONS

U.S. Appl. No. 14/955,334, filed Dec. 1, 2015.
U.S. Appl. No. 14/938,249, filed Nov. 11, 2015.
U.S. Appl. No. 14/833,445, filed Aug. 24, 2015.

* cited by examiner

IMAGE HEATING APPARATUS HAVING FILM, BACK-UP MEMBER FORMING A NIP WITH THE FILM, A HEATER, AND HEAT CONDUCTIVE MEMBERS CONFIGURED TO BE BROUGHT INTO CONTACT WITH HEATER SURFACE OPPOSITE TO THE SURFACE OF THE HEATER BROUGHT INTO CONTACT WITH THE FILM

BACKGROUND OF THE INVENTION

Field of the Invention

The present invention relates to an image heating apparatus to be included in an image forming apparatus employing an electrophotographic system.

Description of the Related Art

Hitherto, as an image heating apparatus to be included in an image forming apparatus adopting an image forming process employing an electrophotographic system, an electrostatic recording system, or other systems, such as a copying machine and an LBP, there has been used one employing a film fixing system. In the image heating apparatus employing the film fixing system, a fixing film and a pressure roller (pressure member) are arranged in pressure-contact with each other, and a heating element for heating the fixing film is arranged to be brought into close contact with an inner surface of the fixing film at a portion at which the fixing film and the pressure member are opposed to each other (nip portion). As the heating element, a ceramic heater is generally used, which is obtained by forming a heat generating resistor on a substrate made of a ceramics such as alumina or aluminum nitride. The heat generating resistor, formed on the ceramic heater, inputs a current in a state obtained by subjecting a primary current flowing from an electrical outlet to power control by a control method such as wavenumber control or phase control in a power supply circuit, thereby generating heat and heating an image. The heating element is supported by a holder (support member) made of a resin or the like, and a temperature detecting element, a safety element, and the like are arranged in contact thereto. Those elements have functions such as input power control based on the detected temperature and current interruption during an abnormal temperature rise.

When the above-mentioned film-heating fixing device including the heating element carries out an operation of heating and fixing an unfixed toner image onto a recording material having a small width in a longitudinal direction (a direction orthogonal to a conveyance direction of the recording material, width direction of the recording material) (small-sized sheet), there is a difference in the heat radiation amount of the film in the longitudinal direction. In other words, a part of the film that is brought into contact with the recording material loses heat to the recording material, but a part that is not brought into contact with the recording material does not lose heat to the recording material. Therefore, at the nip portion, there is caused a phenomenon that the temperature of a region through which the recording material does not pass (non-sheet-passage portion) is higher than the temperature of a region through which the recording material passes (sheet-passage portion), which is what is called non-sheet-passage portion temperature rise. The occurrence of the non-sheet-passage portion temperature rise causes image defects due to temperature unevenness at the nip, wrinkled sheets due to thermal expansion of the pressure roller in the non-sheet-passage portion, sheet conveyance failure, and the like. Further, thermal deterioration of parts of the film and the pressure member corresponding to the non-sheet-passage portion may progress, which may result in damage.

In order to solve the problem of the non-sheet-passage portion temperature rise, in Japanese Patent Application Laid-Open No. H11-84919, there is proposed a configuration in which a high heat conductive member is mounted between the heater substrate and the support member, to thereby obtain a uniform heater temperature distribution in the longitudinal direction. Further, in Japanese Patent Application Laid-Open No. 2014-123100, in order to secure safe use of the high heat conductive member, there is proposed a configuration in which two high heat conductive members are arranged in the longitudinal direction, and one high heat conductive member is brought into contact with a thermistor, while the other high heat conductive member is brought into contact with a fuse. In this configuration, the primary side and the secondary side of the power supply circuit of the image forming apparatus are electrically separated from each other.

In the configuration in which a single high heat conductive member continuous in the longitudinal direction is used as in Japanese Patent Application Laid-Open No. H11-84919, a metal plate (for example, aluminum plate) used as the high heat conductive member is formed into an elongated shape in accordance with the size of the heater, and hence there is a fear of the occurrence of warpage. When warpage occurs, the degree of contact of the high heat conductive member to the heater substrate may become non-uniform in the longitudinal direction.

In the configuration in which a plurality of high heat conductive members are arranged as in Japanese Patent Application Laid-Open No. 2014-123100, the fear of a reduction in the degree of contact between the high heat conductive member and the heater substrate due to the occurrence of warpage is reduced, but a gap is formed between the two high heat conductive members, and hence there arises a new fear in heat conduction uniformity.

SUMMARY OF THE INVENTION

According to a first exemplary embodiment of the present invention, there is provided an image heating apparatus for heating a toner image formed on a recording material while conveying the recording material at a nip portion. The portion, the image heating apparatus includes: a film having a tubular shape; a backup member configured to be brought into contact with an outer surface of the film to form the nip portion; a heater having an elongated shape and being configured to be brought into contact with the film, the heater including a substrate and a heat generating resistor formed on the substrate; a first heat conductive member having a higher thermal conductivity than the substrate and being configured to be brought into contact with a surface of the heater opposite to a surface of the heater that is brought into contact with the film, the first heat conductive member including a plurality of divided first heat conductive members arranged in a longitudinal direction of the heater with a gap formed therebetween; a pinching member configured to pinch the first heat conductive member together with the heater in a thickness direction of the heater; and a second heat conductive member provided in a region of the gap so as to be brought into contact with both of the heater and the pinching member.

According to a second exemplary embodiment of the present invention, there is provided an image heating apparatus for heating a toner image formed on a recording material while conveying the recording material at a nip portion. The image heating apparatus includes: a film having a tubular shape; a backup member configured to be brought into contact with an outer surface of the film to form the nip portion; a heater having an elongated shape and being configured to be brought into contact with the film, the heater including a substrate and a heat generating resistor formed on the substrate; a first heat conductive member having a higher thermal conductivity than the substrate and being configured to be brought into contact with a surface of the heater opposite to a surface of the heater that is brought into contact with the film, the first heat conductive member including a plurality of divided first heat conductive members arranged in a longitudinal direction of the heater with a gap formed therebetween; a pinching member configured to pinch the first heat conductive member together with the heater in a thickness direction of the heater; and a second heat conductive member provided in a region of the gap so as to be brought into contact with both of two of the plurality of divided first heat conductive members, which are opposed to each other across the gap.

Further features of the present invention will become apparent from the following description of exemplary embodiments with reference to the attached drawings.

DESCRIPTION OF THE EMBODIMENT

Exemplary embodiments of the present invention are described below in detail according to various examples with reference to the attached drawings. Note that, the dimensions, materials, shapes, relative positional relationship, and the like of structural components described herein may be appropriately changed depending on the structure of the apparatus to which the present invention is applied and various conditions. Specifically, the scope of the present invention is not meant to be limited to the following embodiments.

<Example 1>

An image heating apparatus according to an example of the present invention is to be included in an image forming apparatus such as a laser beam printer employing an electrophotographic process, and is an apparatus configured to fix an unfixed toner image (developer image) formed on a recording material by the electrophotographic process onto the recording material. Such fixing processing is carried out while conveying the recording material, and the recording material is conveyed in a manner that the center of the recording material in a direction orthogonal to a recording material conveyance direction matches a center reference of a recording material conveyance path. In the following description of the apparatus configuration, the longitudinal direction refers to a direction orthogonal to the recording material conveyance direction in a recording material conveyance path plane, and also refers to a width direction of the recording material to be conveyed. A transverse direction refers to the same direction as the recording material conveyance direction, and also refers to the length direction of the recording material to be conveyed. Note that, the configuration of the image forming apparatus into which the image heating apparatus according to this example is incorporated (configuration other than a heating and fixing portion, such as an image forming portion) is similar to the related art, and thus description thereof is omitted herein.

(Fixing Apparatus (Image Heating Apparatus))

Figure 1:
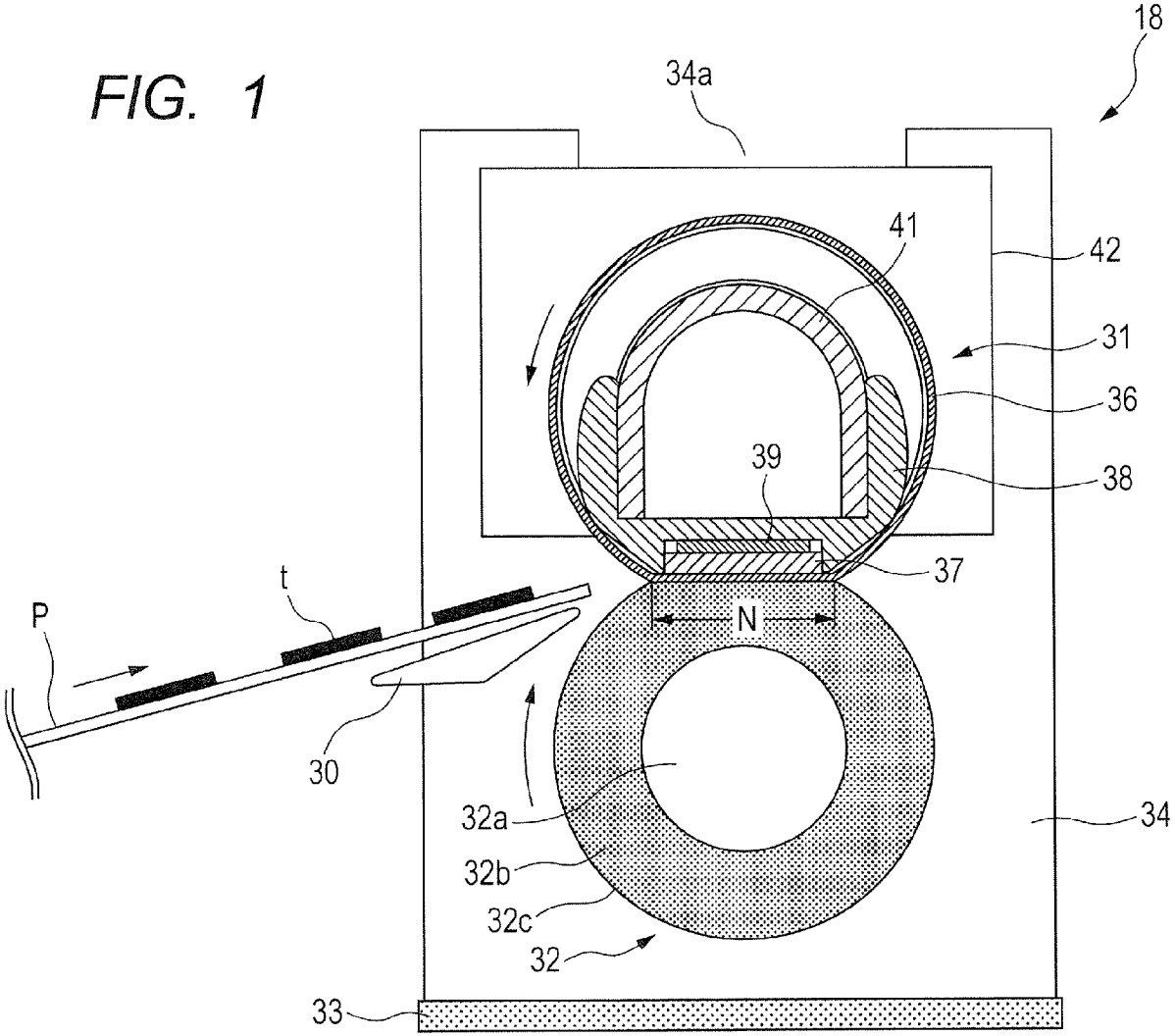
FIG. 1 is a schematic sectional view for illustrating a configuration of an image heating apparatus according to an example of the present invention.
Figure 2:
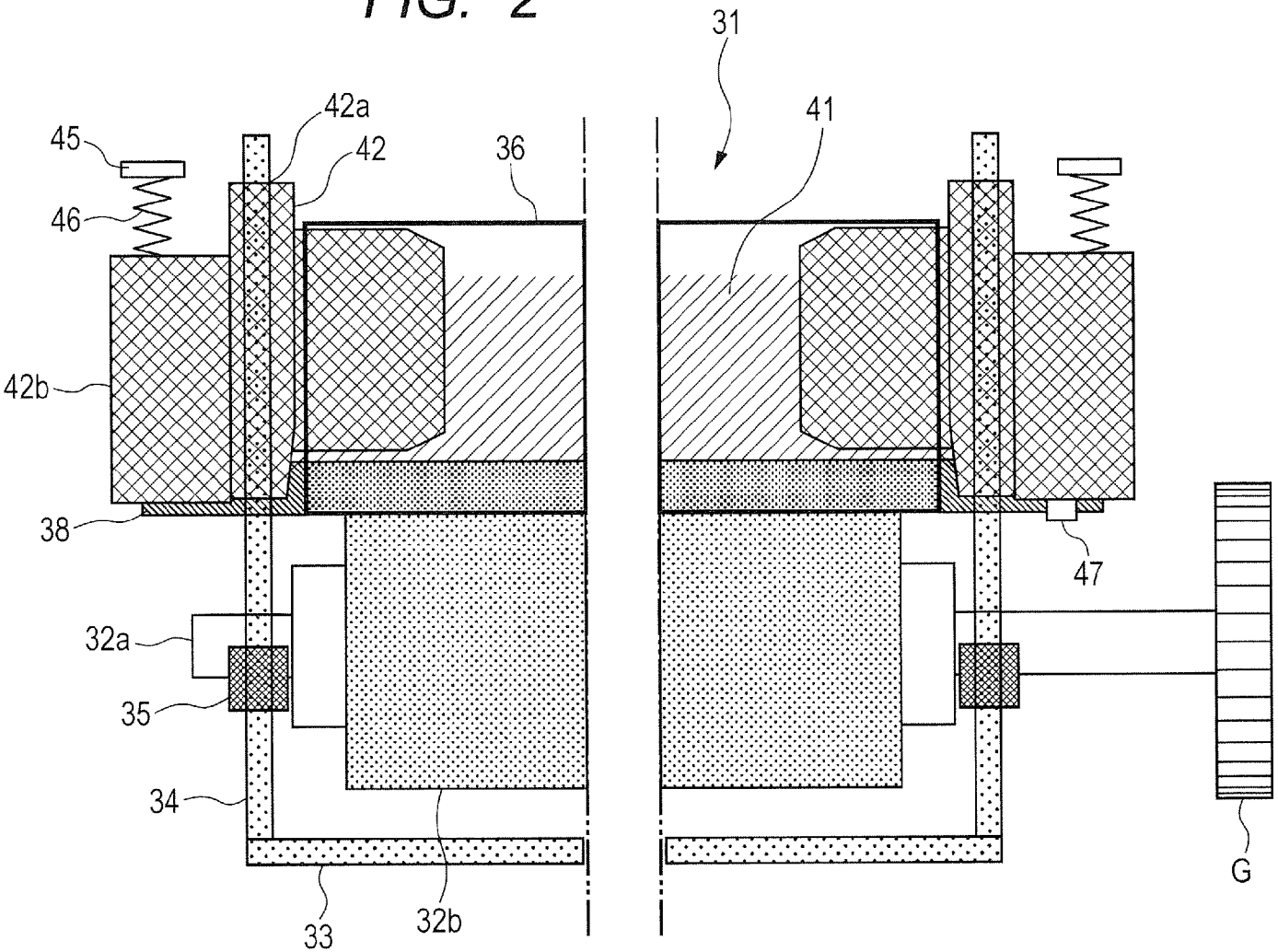
FIG. 2 is a schematic front view for illustrating the configuration of the image heating apparatus according to an example of the present invention.

FIG. 1 is a schematic view of a cross section of a fixing apparatus 18 serving as the image heating apparatus according to this example as viewed from the longitudinal direction. FIG. 2 is a schematic view of the fixing apparatus 18 according to this example as viewed from the transverse direction, in which an illustration of a longitudinal center part is omitted and only configurations around end portions are illustrated.

The fixing apparatus 18 includes a film unit 31 including a flexible tubular film 36 (fixing member), and a pressure roller 32 serving as a pressure member. The film unit 31 and the pressure roller 32 are arranged substantially parallel to each other between right and left side plates 34 of an apparatus frame 33 so that a heater 37 is opposed to the pressure roller 32 through intermediation of the film 36.

The pressure roller 32 includes a metal core 32*a*, an elastic layer 32*b* formed on the outer side of the metal core 32*a*, and a releasing layer 32*c* formed on the outer side of the elastic layer 32*b*. As the material of the elastic layer 32*b*, silicone rubber or fluoro-rubber is used. As the material of the releasing layer 32*c*, PFA, PTFE, or FEP is used. In this example, the following pressure roller 32 was used. Specifically, on the stainless-steel metal core 32*a* having an outer diameter of 11 mm, the silicone rubber layer 32*b* having a thickness of about 3.5 mm was formed by injection molding, and the outer side thereof was covered with the PFA resin tube 32*c* having a thickness of about 40 μm. The outer diameter of the pressure roller 32 is 18 mm. The hardness of the pressure roller 32 is desired to be within a range of from 40° to 70° when being measured with an Asker-C hardness tester under a load of 9.8 N from viewpoints of securing a nip N and durability. In this example, the hardness is adjusted to 54°. The longitudinal length of the elastic layer of the pressure roller 32 is 226 mm.

As illustrated in FIG. 2, the pressure roller 32 is supported at both longitudinal ends of the metal core 32*a* so as to be rotatable between the side plates 34 of the apparatus frame via bearing members 35, respectively. A drive gear G is fixed to one end portion of the metal core 32*a* of the pressure roller. A rotational force is transmitted from a drive source (not shown) to the drive gear G, to thereby rotationally drive the pressure roller 32.

As illustrated in FIG. 1, the film unit 31 includes the film 36, the plate-shaped elongated heater 37 that is in contact with the inner surface (inner peripheral surface) of the film 36, a support member 38 configured to support the heater 37, and a metal plate 39 serving as a high heat conductive member. The film unit 31 further includes a pressure stay 41 configured to reinforce the support member 38, and flanges 42 configured to restrict the longitudinal movement of the film 36. The film 36 is a tubular flexible member including a base layer, an elastic layer formed on the outer side of the base layer, and a releasing layer formed on the outer side of the elastic layer. The inner diameter of the film 36 of this example is 18 mm, a polyimide base material having a thickness of 60 μm is used as the base layer, silicone rubber having a thickness of about 150 μm is used as the elastic layer, and a PFA resin tube having a thickness of 15 μm is used as the releasing layer. As illustrated in FIG. 1, the support member 38 is a member having properties such as rigidity, heat resistance, and heat insulation, and has a lateral cross section shaped into a substantially semicircular gutter. In this example, the support member 38 is made of liquid crystal polymer. The support member 38 has a role of supporting the inner surface of the film 36 that is fitted onto the support member 38, and a role of supporting one surface of the heater 37.

Figure 3:
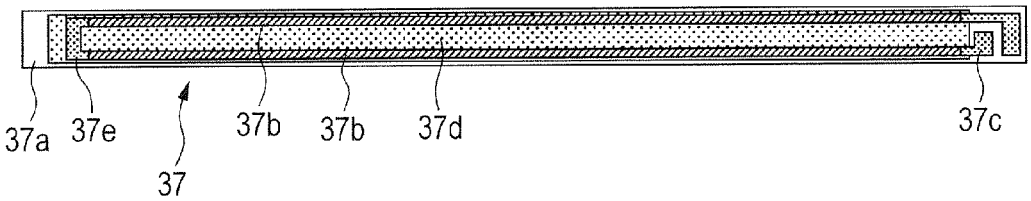
FIG. 3 is a schematic view for illustrating a configuration of a ceramic heater.

FIG. 3 is a schematic view for illustrating the configuration of the heater 37. The heater 37 is formed as follows. On a substrate 37*a* made of a ceramics such as alumina or aluminum nitride, a heat generating resistor 37*b*, made of a silver-palladium alloy or the like, is formed by screen printing or the like, and further an electrical contact portion 37*c*, made of silver or the like, is connected to the heat generating resistor 37*b*. In this example, two heat generating resistors 37*b* are connected in series, and the resistance value thereof is 18Ω. A glass coat 37*d* serving as a protective layer is formed on the heat generating resistors 37*b* so as to protect the heat generating resistors 37*b* and improve sliding performance with respect to the film 36. This heater 37 is arranged along a generatrix direction of the film 36 while being opposed to a support surface of the support member 38.

The substrate 37*a* of the heater 37 of this example has a cuboid shape with a longitudinal length of 270 mm, a transverse length of 5.8 mm, and a thickness of 1.0 mm, and is made of alumina (thermal conductivity of 20 W/(mK)). The heat generating resistors 37*b* form a pattern of being folded at a longitudinal end portion via an electrical contact portion 37*e*, and have the same shape on both of the upstream side and the downstream side in the recording material conveyance direction. The heat generating resistors 37*b* each have a longitudinal length of 222 mm and a transverse length of 0.9 mm. Further, the position in the transverse direction of the heat generating resistor 37*b* is positioned 0.7 mm from the end of the ceramic substrate 37*a* on both of the upstream side and the downstream side, and the heat generating resistors 37*b* are printed at positions symmetric about the transverse center. Note that, grease having heat resistance is applied onto the inner surface of the film 36 so as to improve the sliding performance of the heater 37 and the support member 38 with respect to the inner surface of the film 36.

Figure 4:
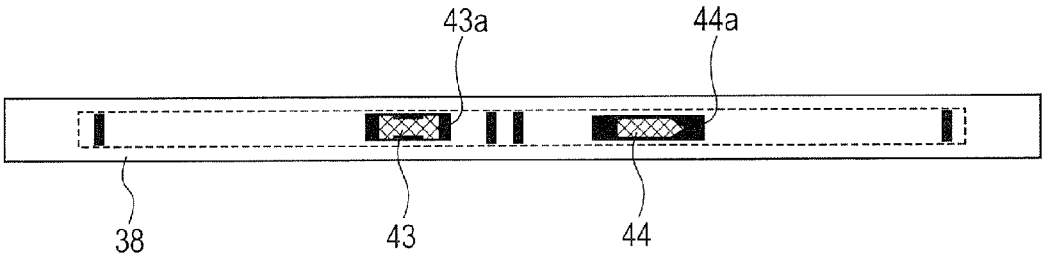
FIG. 4 is a schematic view for illustrating configurations of a thermistor and a thermal fuse.

FIG. 4 is a schematic view for illustrating the support member 38, and a thermistor 43 and a thermal fuse 44 serving as thermosensitive elements. The support member 38 has through holes 43*a* and 44*a* formed therein. The thermistor 43, serving as a temperature detecting element, and the thermal fuse 44, serving as a safety element, are arranged through the through hole 43*a* and the through hole 44*a* so as to be brought into contact with metal plates 39 and 40, respectively. In other words, the thermosensitive elements are arranged on the metal plates 39 and 40 so as to sense the heat of the heater 37 via the metal plates 39 and 40.

In the thermistor 43 (temperature detecting member), in order to stabilize a contact state between a casing of the thermistor 43 and the metal plate 39 (another of the first heat conductive members), a thermistor element is arranged under a state in which ceramic paper or the like is interposed between the casing and the metal plate 39, and the thermistor element is further covered with an insulating material such as a polyimide tape. The thermal fuse 44 (current cut-off member) is a component configured to be actuated when sensing abnormal heat generation of the heater in response to an abnormal temperature rise of the heater 37, to thereby interrupt energization to the heater 37. In the thermal fuse 44, a fuse element that melts at a predetermined temperature is mounted in a cylindrical metal casing, and when the fuse element is fused due to an abnormal temperature rise of the heater 37, a circuit for energizing the heater 37 is interrupted. The thermal fuse 44 is mounted on the metal plate 40 (one of the first heat conductive members) via thermal conductive grease, to thereby prevent operation failure due to rising of the thermal fuse 44 with respect to the heater 37.

As illustrated in FIG. 1, the pressure stay 41 is a member that is long in the generatrix direction of the film 36 and has a lateral cross section formed into a U-shape. The pressure stay 41 has a role of increasing the bending rigidity of the film unit 31. The pressure stay 41 of this example is formed by bending a stainless-steel plate having a thickness of 1.6 mm. The right and left flanges 42 hold both end portions of the pressure stay 41, and vertical groove portions 42*a* of the right and left flanges 42 are respectively engaged with vertical groove portions 34*a* of the right and left side plates 34 of the apparatus frame 33. In this example, a liquid crystal polymer resin is used as the material of the flange 42.

As illustrated in FIG. 2, a pressure spring 46 that is arranged between a pressure arm 45 and a pressure portion 42*b* of each of the right and left flanges 42 presses the heater 37 toward the pressure roller 32 through intermediation of the film 36 via each of the right and left flanges 42, the pressure stay 41, and the support member 38. In this example, the total pressure-contact force between the film 36 and the pressure roller 32 is 180 N. With this, the heater 37 forms the nip portion N having a width of about 6 mm together with the pressure roller 32 through intermediation of the film 36 against the elasticity of the pressure roller 32.

When the fixing apparatus 18 is operated, a rotational force is transmitted from the drive source (not shown) to the drive gear G for the pressure roller 32 so as to rotationally drive the pressure roller 32 at a predetermined speed in a clockwise direction in FIG. 1. In this example, the rotational speed of the pressure roller 32 was set so that the conveyance speed of the recording material was 100 mm/sec. A rotational force acts on the film 36 due to a frictional force acting between the outer surface (outer peripheral surface)

of the pressure roller 32 and the outer surface (outer peripheral surface) of the film 36 at the nip portion N along with the rotational drive of the pressure roller 32. With this arrangement, as illustrated in FIG. 1, the film 36 is slid while being in contact with one surface of the heater 37 and is rotated in association with the rotation of the pressure roller 32 in a counterclockwise direction around the support member 38.

Under a state in which the film 36 is rotated and the heater 37 is energized so that the temperature of the heater 37 detected by the thermistor 43 reaches a target temperature, a recording material P is introduced. A fixing entrance guide 30 plays the role of guiding the recording material P carrying a toner image t in an unfixed state toward the nip portion N. The recording material P introduced into the nip portion N has its surface carrying the unfixed toner image t brought into close contact with the film 36 at the nip portion N, and is nipped and conveyed through the nip portion N together with the film 36. In this conveyance process, due to the heat of the film 36 heated by the heater 37, the unfixed toner image t on the recording material P is heated and pressurized onto the recording material P to be melted and fixed. The recording material P that has passed through the nip portion N is self-stripped from the surface of the film 36, to thereby be delivered outside the apparatus by a delivery roller pair (not shown). Note that, the maximum sheet passable width of the fixing apparatus in this example is 216 mm, and an LTR-sized recording material can be printed at a speed of 20 PPM.

(Characteristics of Example)

With reference to FIG. 5A to FIG. 6B, the metal plates 39 and 40 serving as the high heat conductive members (first heat conductive members) of this example and a method of holding those metal plates 39 and 40 are described.

Figure 5A:
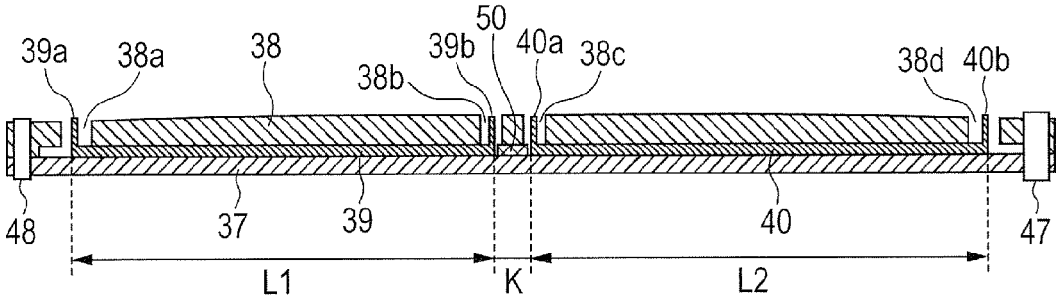
FIGS. 5A, 5B and 5C are schematic views for illustrating a configuration for holding the heater and metal plates in Example 1.
Figure 5B:
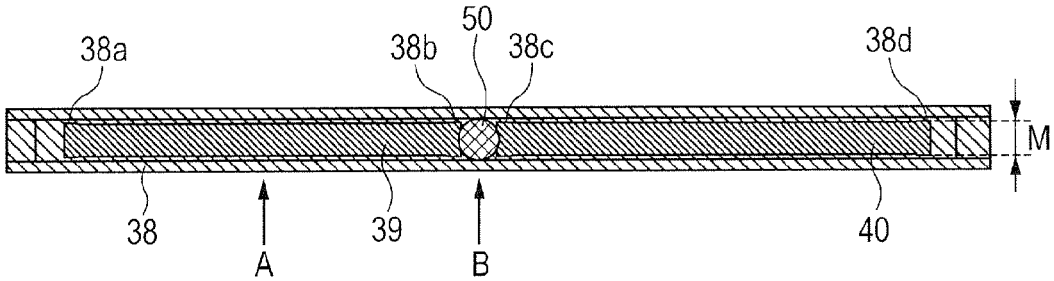
Figure 5C:
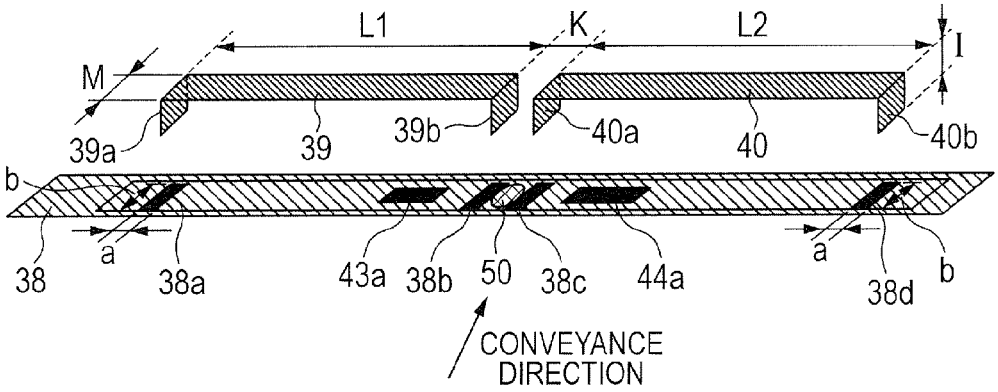

FIG. 5A to FIG. 5C are schematic views for illustrating the configuration for holding the heater 37 and the metal plates 39 and 40 in this example. FIG. 5A is a schematic view for illustrating the cross sections of the heater 37, the support member 38, and the metal plates 39 and 40 taken along the longitudinal direction. FIG. 5B is a schematic view for illustrating a state in which the metal plates 39 and 40 are mounted on the support member 38 under a state in which the heater 37 is removed. FIG. 5C is a schematic perspective view for illustrating a configuration of metal plate engaging portions. Note that, in FIG. 5A to FIG. 5C, the illustration of the thermistor 43 and the thermal fuse 44 is omitted.

Figure 6A:
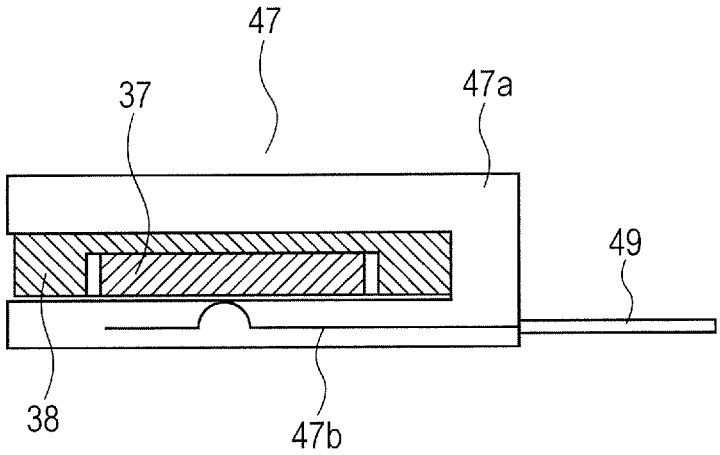
FIGS. 6A and 6B are schematic views for illustrating configurations of heater holding members.
Figure 6B:
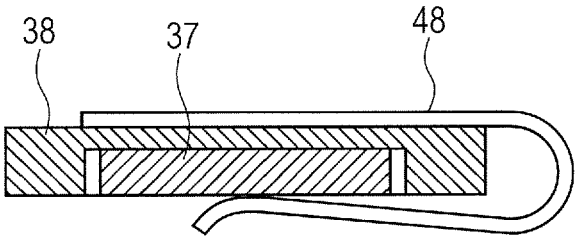

FIG. 6A is an explanatory view of a power feeding connector 47 serving as a heater holding member, and FIG. 6B is an explanatory view of a heater clip 48 also serving as the heater holding member.

As illustrated in FIG. 5A and FIG. 5B, in this example, the metal plates 39 and 40 are mounted on the support member 38, and the heater 37 is further mounted thereon. In other words, the support member 38 also has a role as a pinching member, configured to pinch the metal plates 39 and 40 together with the heater 37 in the thickness direction of the heater 37. Further, as illustrated in FIG. 6A and FIG. 6B, the end portions of the heater 37 are held in contact with the end portions of the support member 38 by the power feeding connector 47 and the heater clip 48, serving as the holding members.

The longitudinal center portion of the heater 37 is supported by the support member 38 through the intermediation of the metal plates 39 and 40, and the longitudinal end portions of the heater 37 are supported in contact with the support member 38.

As illustrated in FIG. 6A, the power feeding connector 47 includes a horizontal U-shaped housing portion 47*a* made of a resin, and a contact terminal 47*b*. The power feeding connector 47 holds the heater 37 and the support member 38 while sandwiching the heater 37 and the support member 38 in the thickness direction thereof, and the contact terminal 47*b* is brought into contact with the electrode 37*c* of the heater 37 to be electrically connected thereto. Note that, in this example, the power feeding connector 47 is used as the heater holding member, but the role of feeding power to the heater and the role as the heater holding member may be separated and performed by separate members. The contact terminal 47*b* is connected to a wire harness 49, and the wire harness 49 is connected to an AC power source or a triac (not shown) provided in the apparatus main body of the image forming apparatus.

As illustrated in FIG. 6B, the heater clip 48 is formed of a metal plate bent into a horizontal U-shape, and its spring property causes the end of the heater 37 to be held in contact with the support member 38 as the holding member. Further, the end portion of the heater held by the heater clip 48 is movable in a heater sliding in-plane direction. With this, when the heater 37 is thermally expanded, and the application of unnecessary stress to the heater 37 is prevented.

With reference to FIG. 5C, the engaging portions between the metal plates 39 and 40 and the support member 38 are described. In this example, as each of the metal plates 39 and 40, an aluminum plate having a constant thickness of 0.3 mm is used. The aluminum plates 39 and 40 each have a thermal conductivity of 200 W/(mK), and have a conveyance-direction width M of 4 mm at an abutment portion against the heater 37. The aluminum plate 39 has a longitudinal width L1 of 102 mm, and the aluminum plate 40 has a longitudinal width L2 of 115 mm. The aluminum plates 39 and 40 are arranged to be separated from each other in the width direction of the recording material at an interval K of 5 mm at a center portion. The aluminum plates 39 and 40 are arranged so as to overlap a region in which the recording material having a width smaller than a recording material having the maximum width that can be conveyed by this apparatus does not pass at the nip portion in the longitudinal direction of the substrate 37*a*. The aluminum plate 39 has bending portions 39*a* and 39*b* having a length l of 3 mm at both longitudinal end portions thereof, and the bending portions 39*a* and 39*b* are respectively inserted into mounting holes 38*a* and 38*b* of the support member 38. Similarly, the aluminum plate 40 has bending portions 40*a* and 40*b* having a length l of 3 mm at both longitudinal end portions thereof, and the bending portions 40*a* and 40*b* are respectively inserted into mounting holes 38*c* and 38*d* of the support member 38. Note that, those mounting holes 38*a* to 38*d* all have the same size, and are formed slightly larger than the bending portions in order to absorb the thermal expansion of the aluminum plates 39 and 40. In this example, each of the mounting holes 38*a* to 38*d* has a longitudinal dimension a of 0.4 mm and a transverse dimension b of 4.1 mm.

Figure 7A:
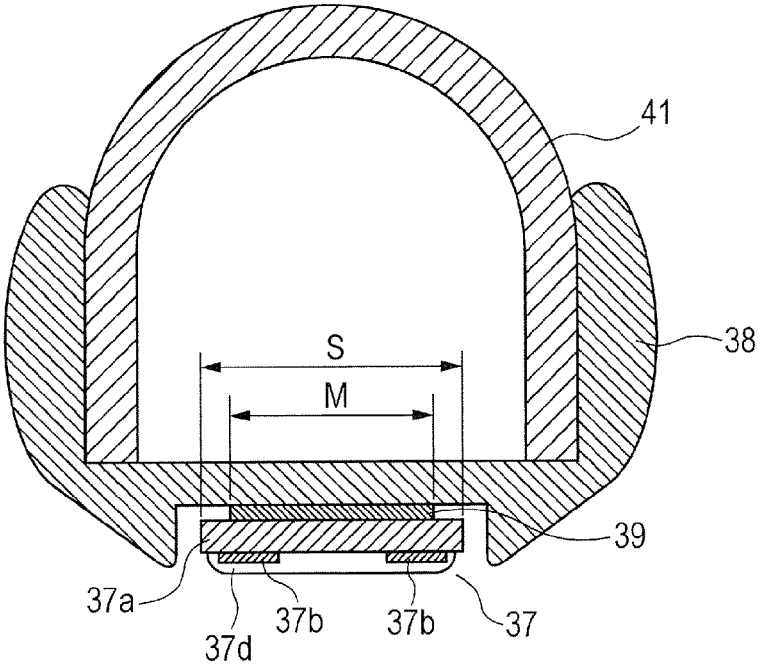
FIGS. 7A and 7B are schematic sectional views for illustrating a configuration of a metal plate gap portion in Example 1.
Figure 7B:
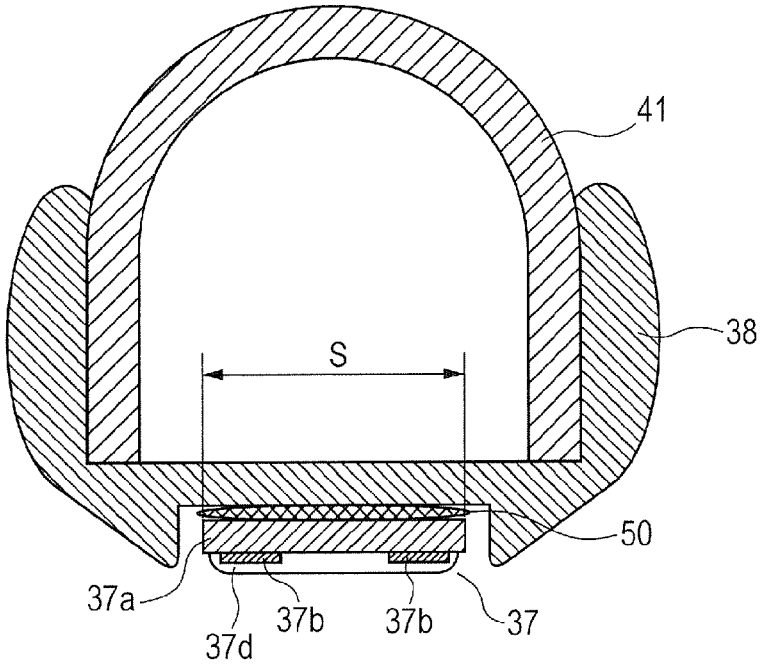

FIG. 7A and FIG. 7B are sectional views of the fixing apparatus of this example. FIG. 7A is a sectional view of a part A indicated by the arrow in FIG. 5B. In the heater 37, a surface of the substrate 37*a* on an opposite side to a surface where the heat generating resistors 37*b* are formed is received by the aluminum plate 39 on the support member 38. The width S of the substrate 37*a* is 5.8 mm, and the conveyance-direction width M of the aluminum plate 39 is 4 mm. FIG. 7B is a sectional view of an aluminum plate gap portion of a part B indicated by the arrow in FIG. 5B. In a region K of 5 mm formed between the aluminum plate 39 and the aluminum plate 40, grease 50 (second heat conductive member) is applied to fill the region between the aluminum plates 39 and 40, and the heater 37 and the support member 38 are in contact with each other via the grease 50. Note that, as the grease 50, 30 mg of SC102 produced by Dow Corning Toray Co., Ltd. is applied, which has a thermal conductivity of 0.9 W/(mK). Note that, the surface of the heater 37 to be brought into contact with the aluminum plates 39 and 40 is not limited to the above-mentioned surface of the substrate 37*a* on the opposite side, and the aluminum plates 39 and 40 may be brought into contact with the surface where the heat generating resistors 37*b* are formed.

(Behavior of Example)

Figure 8A:
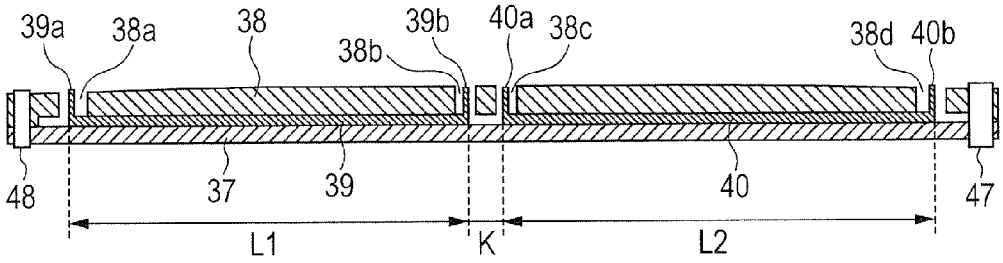
FIGS. 8A, 8B and 8C are schematic views for illustrating a configuration for holding a heater and metal plates in a Comparative Example.
Figure 8B:
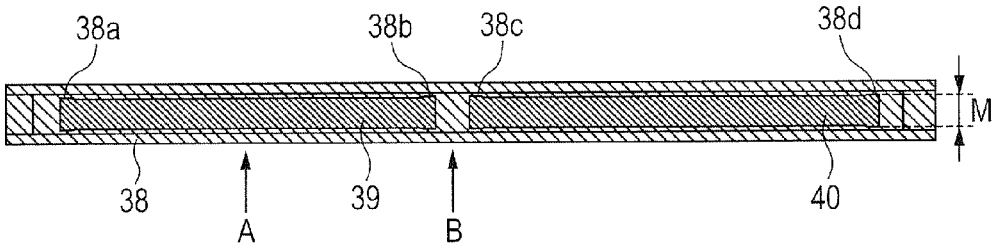
Figure 8C:
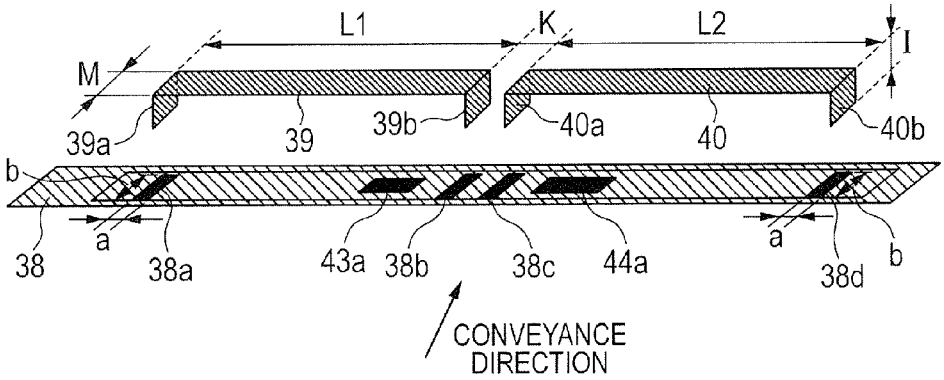

FIG. 8A to FIG. 8C are schematic views for illustrating a configuration for holding a heater and metal plates in a Comparative Example of this example. FIG. 8A is a longitudinal sectional view, and FIG. 8B is a view of a state in which the metal plates 39 and 40 are mounted on the support member 38 under a state in which the heater 37 is removed.

Figure 9:
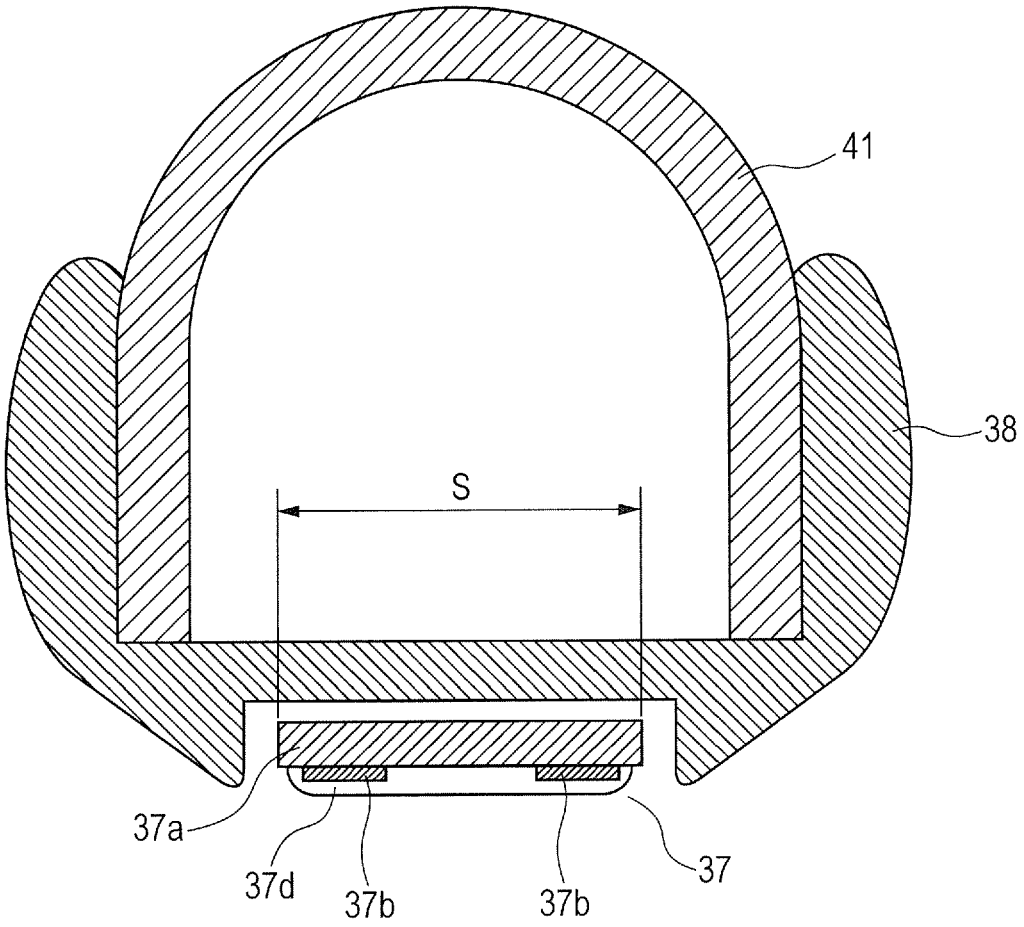
FIG. 9 is a schematic sectional view for illustrating a metal plate gap portion in a Comparative Example.

FIG. 9 is a schematic sectional view of the aluminum plate gap portion of a part B indicated by the arrow in FIG. 8B. In the region between the aluminum plate 39 and the aluminum plate 40, a heat conductive member such as the grease 50 of this example is not provided, and an air gap of 0.3 mm, which corresponds to the thickness of the aluminum plate, is formed between the heater 37 and the support member 38. Configurations other than the configuration at this gap portion are common in the Comparative Example and this example. Common configurations are denoted by the same reference symbols as this example, and description thereof is omitted herein.

Figure 10:
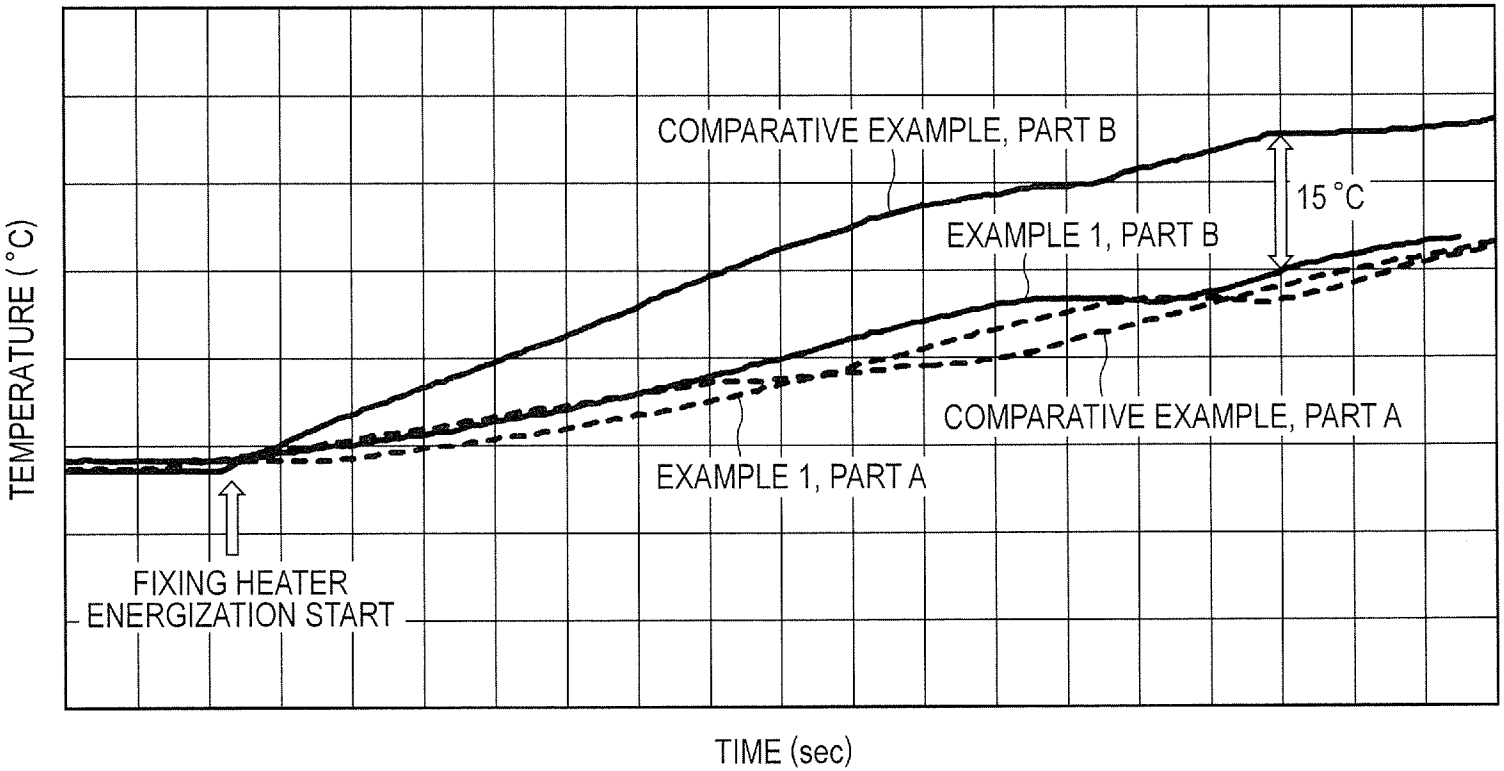
FIG. 10 is a graph for showing comparison in heater back-side temperature change between Example 1 and a Comparative Example.

FIG. 10 is a graph for showing comparison in heater back-side temperature change between this example and the Comparative Example of this example. A thermocouple is mounted on the back side of the heater at a center portion in the conveyance direction, and the heater back-side temperature is measured from a fixing heater energization start. For this example, the temperatures of the part A and the part B of FIG. 5B are measured, and for the Comparative Example, the temperatures of the part A and the part B of FIG. 8B are measured. When the heater back-side temperature after the elapse of three seconds from the fixing heater energization start is compared, in the Comparative Example, the temperature of the part B is higher than that of the part A by about 17° C., while in this example, the temperature of the part B is higher than that of the part A by about 2° C. to 3° C. There is no difference in configuration of the part A between this example and the Comparative Example, and hence the temperature transition of the part A is substantially the same. As compared in the part B, it is understood that this example is reduced in heater back-side temperature by about 15° C. with respect to the Comparative Example.

As a result of printing an image under this state, in the Comparative Example, hot offset occurred at the gap portion between the aluminum plates when the first sheet was printed. This was caused because the temperature of the back side of the heater was locally increased and the film surface temperature at this position was increased as well. When the film surface temperature of the Comparative Example was measured with a radiation thermometer, it was understood that the temperature of the part B was higher than that of the part A by about 5° C. immediately before the printing of the first sheet. This hot offset remarkably occurs immediately after the temperature of the image heating apparatus rises to the fixing temperature from a state in which the image heating apparatus is sufficiently cooled at normal temperature. When printing is repeated, the temperature on the back side of the heater is equalized, and hence the hot offset is gradually eliminated. In the Comparative Example, the hot offset becomes mild in the second sheet, and is eliminated in the third sheet.

Then, in this example, the temperature on the back side of the heater became more uniform as compared to the Comparative Example, thereby being capable of obtaining a satisfactory image even in the first sheet without causing the hot offset. This is because a gap between the aluminum plates 39 and 40 is filled with the grease 50, and heat is conducted from the back side of the heater 37 to the support member 38 through the grease 50 even in the gap portion between the aluminum plates 39 and 40, thereby preventing the back side of the heater 37 from locally increasing in temperature at the gap portion.

Note that, in this example, SC102 was employed, as the grease, but when SC4476cv (thermal conductivity: 3.1 W/(mK), produced by Dow Corning Toray Co., Ltd.) or the like, which is better in thermal conductivity than SC102, is used, the temperature difference on the back side of the heater is further reduced. Further, grease such as HP300 (thermal conductivity: 0.2 W/(mK), produced by Dow Corning Toray Co., Ltd.), which is lower in thermal conductivity than SC102, may be used. Also in this case, thermal conduction is increased as compared to the case of air having a thermal conductivity of 0.025 W/(mK), which corresponds to a case where an air layer is formed between the heater 37 and the support member 38. Therefore, the effect can be obtained at a certain level. All of those greases have an insulating property. When the metal plates are electrically separated from each other for the reason described in Example 7 of Japanese Patent Application Laid-Open No. 2014-123100, the grease is required to have the insulating property. On the other hand, when the metal plates are separated from each other not for electrical separation but for avoiding occurrence of warpage, conductive grease may be used without a problem. However, when the thermal conduction property is excessively high, there is a fear in that the effect of separating the metal plates, which has been originally made from the viewpoint of the lateral difference in heat capacity of the image heating apparatus, is reduced. Therefore, it is preferred that a type of the grease having the optimum physical property be selected depending on the purpose.

As described above, according to the configuration of this example, the grease is applied between the high heat conductive members, thereby being capable of suppressing the temperature rise of the heater at a region between the high heat conductive members. With this arrangement, while maintaining the heat equalizing effect of the high heat conductive member of the related art, the occurrence of the hot offset due to the local temperature rise of the heating element is prevented, thereby rendering the apparatus capable of obtaining a satisfactory image.

In this example, two first heat conductive members are arranged to be separated from, each other in the longitudinal direction, but the number of the first heat conductive members to be provided is not particularly limited. Three or more first heat conductive members may be arranged to be separated from, each other in the longitudinal direction within a range capable of reducing the influence of the warpage of the metal plates and suitable for formation of a uniform temperature distribution in the longitudinal direction. In this case, the second heat conductive member may be provided at each gap between the first heat conductive members. Further, how the gap between the first heat conductive members is filled with the second heat conductive member is not required to satisfy a state in which, for example, the gap portion between the first heat conductive members is completely filled with the second heat conductive member as long as the above-mentioned local temperature rise can be suppressed. That is, it is only required to secure such a configuration that, at the gap portion, a space between the heater and the support member is filled (connected) so as to enable thermal conduction. Further, as long as the thermal conductivity of the second heat conductive member is higher than at least the thermal conductivity of air, the relationship with respect to the thermal conductivity of the substrate or the first heat conductive member may be appropriately set within a range capable of suppressing the above-mentioned local temperature rise. The size of the gap between the first heat conductive members and other various dimensional relationships may also be appropriately set as long as a uniform temperature distribution can be obtained in the longitudinal direction.

<Example 2>

In Example 2 of the present invention, there is described an example of a case where an elastic member is used as the second heat conductive member provided between the plurality of first heat conductive members. The schematic configuration of the fixing apparatus in this example is the same as Example 1. Therefore, a description of the common configuration is omitted, and only a characteristic part of this example is described.

(Characteristics of Example)

Figure 11A:
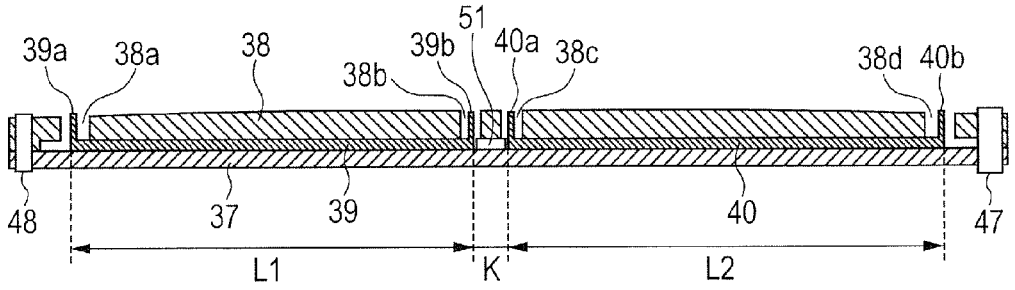
FIGS. 11A, 11B and 11C are schematic views for illustrating a configuration for holding a heater and metal plates in Example 2.
Figure 11B:
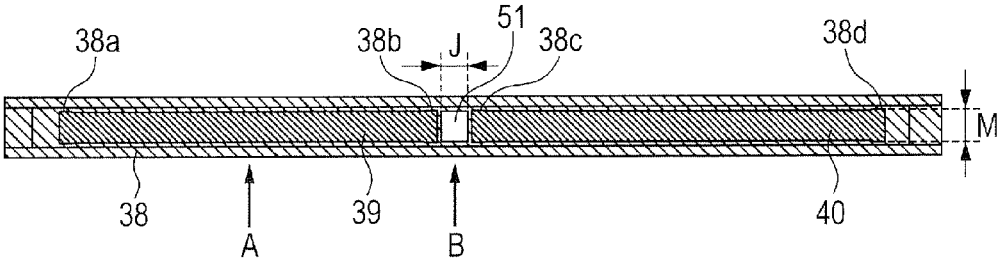
Figure 11C:
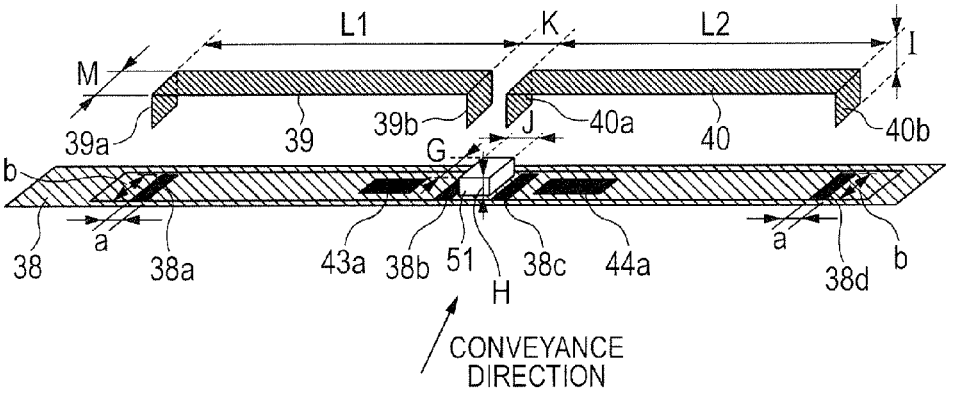

FIG. 11A to FIG. 11C are schematic views for illustrating a configuration for holding the heater 37 and the metal plates 39 and 40 in Example 2. FIG. 11A is a schematic view for illustrating cross sections of the heater 37, the support member 38, and the metal plates 39 and 40 taken along the longitudinal direction. FIG. 11B is a schematic view for illustrating a state in which the metal plates 39 and 40 are mounted on the support member 38 under a state in which the heater 37 is removed. FIG. 11C is a perspective view for illustrating the aluminum plate engaging portions and the heat conductive members. In FIG. 11C, a silicone rubber piece 51 serving as the second heat conductive member is arranged between the aluminum plates 39 and 40. The size of the silicone rubber 51 is a longitudinal width J of 4 mm, a conveyance-direction width G of 3 mm, and a height H of 2 mm, and the silicone rubber 51 is fixed to adhere on a seat surface of the support member 38. Further, as the silicone rubber 51, insulating LTV rubber having an Asker-C hardness of 18° and a thermal conductivity of 0.2 W/(mK) is used.

Figure 12:
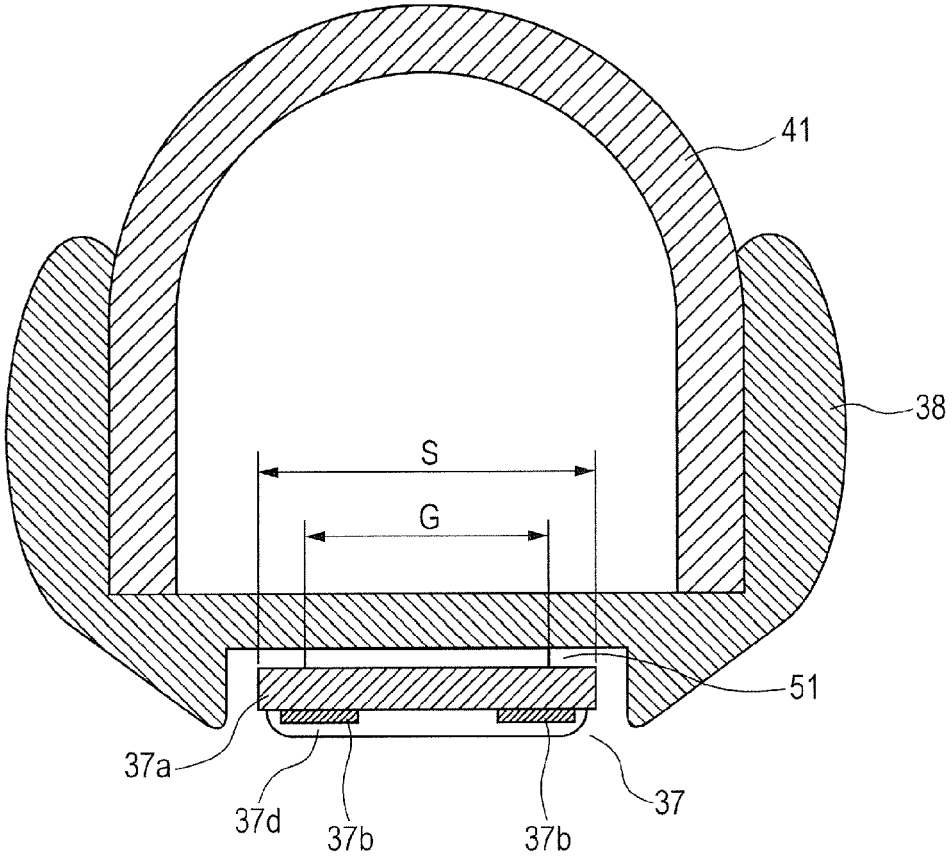
FIG. 12 is a schematic sectional view for illustrating a configuration of a metal plate gap portion in Example 2.

FIG. 12 is a schematic sectional view of the fixing apparatus according to this example at the aluminum plate gap of the part B indicated by the arrow in FIG. 11B. The silicone rubber 51 is arranged in a region between the aluminum plates 39 and 40. The silicone rubber 51 receives a compression force due to the pressure-contact force of 180 N generated between the film 36 and the pressure roller 32 at the fixing nip portion N, and thus is elastically deformed to have the same height as the aluminum plates 39 and 40. In this manner, the heater 37 and the support member 38 are in a contact, state through intermediation of the silicone rubber 51.

(Action of Example)

Figure 13:
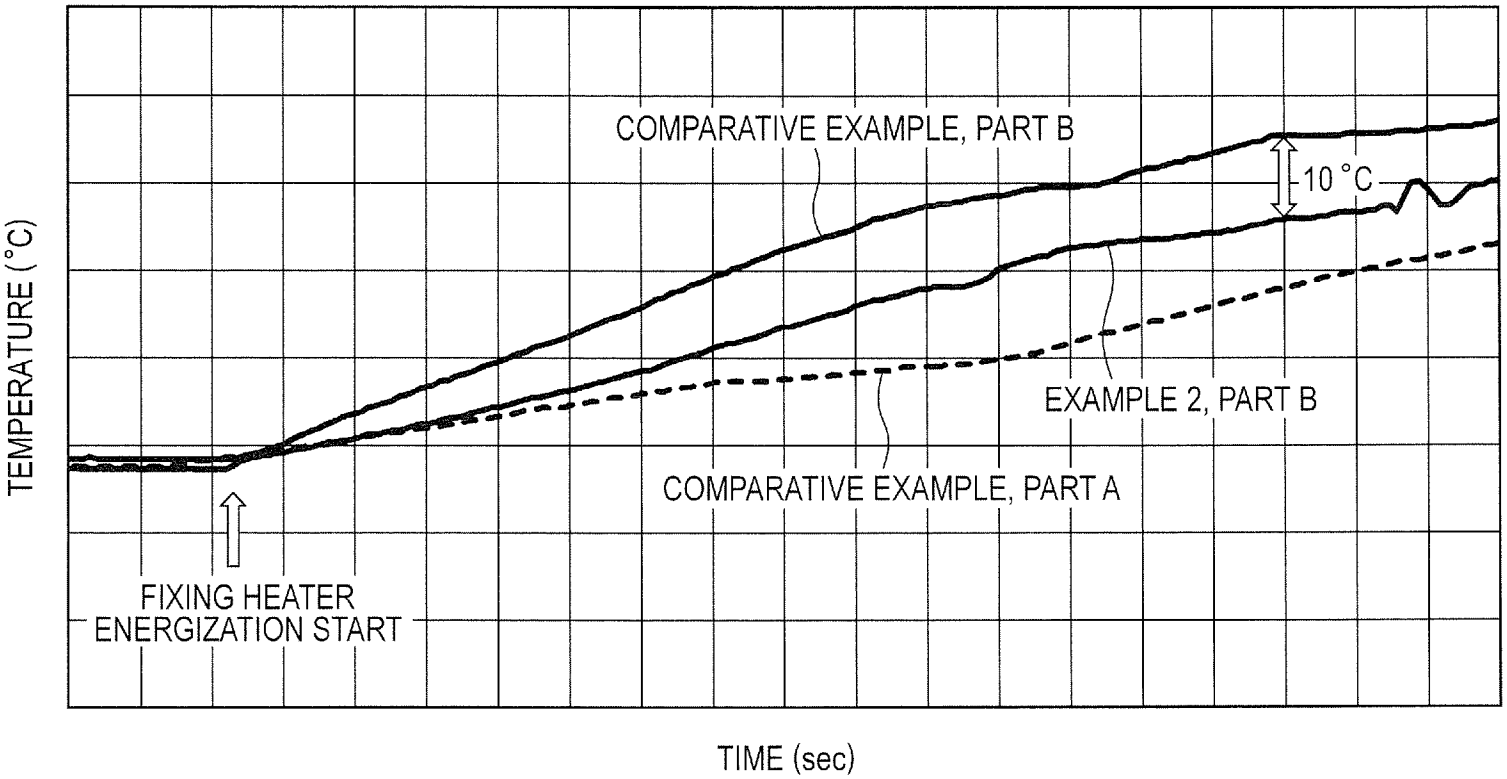
FIG. 13 is a graph for showing comparison in heater back-side temperature change at the metal plate gap portion between Example 2 and a Comparative Example.

A fixing apparatus according to a Comparative Example of this example has the same configuration as the Comparative Example of Example 1 illustrated in FIG. 8A to FIG. 9. FIG. 13 is a graph for showing comparison in heater back-side temperature change between this example and the Comparative Example of this example. For this example, the temperatures of the part A and the part B of FIG. 11B are measured, and for the Comparative Example, the temperatures of the part A and the part B of FIG. 8B are measured. There is no difference in configuration of the part A between this example and the Comparative Example, and hence the temperature transition of the part A is substantially the same. Therefore, indication of the temperature of the part A of this example is omitted. As compared in the part B, it is understood that this example is reduced in heater back-side temperature by about 10° C. with respect to Comparative Example.

As a result of printing an image under this state, in the Comparative Example, hot offset occurred at the gap portion between the aluminum plates when the first sheet was printed. The hot offset became mild in the second sheet, and was eliminated in the third sheet. Then, in this example, the temperature on the back side of the heater was more equalized as compared to the Comparative Example, and the hot offset did not occur even in the first sheet, thereby being capable of obtaining a satisfactory image. This is because a gap between the aluminum plates 39 and 40 is filled with the compressed silicone rubber 51, and heat is conducted from the back side of the heater 37 to the support member 38 through intermediation of the silicone rubber 51 even at the gap portion between the aluminum plates 39 and 40, thereby preventing the back side of the heater 37 from locally increasing in temperature at the gap portion.

Note that, in this example, silicone solid rubber is employed as the second heat conductive member, but elastic members such as foamed rubber and sponge may be employed. Such elastic members have a lower thermal conductivity than solid rubber, but the thermal conduction is better than the case of air having the thermal conductivity of 0.025 W/(mK), which corresponds to a case where an air layer is formed between the heater 37 and the support member 38. Therefore, the effect can be obtained at a certain level. When the metal plates are electrically separated from each other for the reason described in Example 7 of Japanese Patent Application Laid-open No. 2014-123100, the elastic member is required to have the insulating property. When the metal plates are separated from each other not for electrical separation but for avoiding occurrence of warpage, a conductive elastic member may be used without a problem. Therefore, it is preferred that an elastic member having the optimum physical property be selected depending on the purpose.

As described above, according to the configuration of this example, the elastic member is arranged between the high heat conductive members, thereby allowing the apparatus to suppress the temperature rise of the heater at a region between the high heat conductive members. With this arrangement, while maintaining the heat equalizing effect of the high heat conductive member of the related art, the occurrence of the hot offset due to the local temperature rise of the heating element is prevented, thereby rendering the apparatus capable of obtaining a satisfactory image.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-231522, filed Nov. 14, 2014, which is hereby incorporated by reference herein in its entirety.

What is claimed is:

1. An image heating apparatus for heating a toner image formed on a recording material while conveying the recording material at a nip portion, the image heating apparatus comprising:

a film having a tubular shape;

a backup member configured to be brought into contact with an outer surface of the film to form the nip portion;

a heater having an elongated shape, configured to be brought into contact with the film, the heater including a substrate and a heat generating resistor formed on the substrate;

a plurality of heat conductive members having a higher thermal conductivity than the substrate, the plurality of heat conductive members configured to be brought into contact with a surface of the heater opposite to a surface of the heater that is brought into contact with the film, the plurality of heat conductive members arranged in a longitudinal direction of the heater with a gap formed therebetween;

a support member configured to support the heater through the plurality of heat conductive members, the support member pinching the plurality of heat conductive members with the heater in a thickness direction of the heater, wherein a lubricant is applied in a region of the gap so as to be brought into contact with both of the heater and the support member.

2. The image heating apparatus according to claim 1, wherein the lubricant has an insulating property.

3. The image heating apparatus according to claim 1, wherein the plurality of heat conductive members is provided across a passage region and a non-passage region of a small-sized recording material in the longitudinal direction of the heater.

4. The image heating apparatus according to claim 1, wherein the lubricant is a grease.

5. The image heating apparatus according to claim 1, wherein, in the region of the gap, the lubricant is applied so as to be brought into contact with the plurality of first heat conductive members arranged on both sides of the gap.

6. An image heating apparatus for heating a toner image formed on a recording material while conveying the recording material at a nip portion, the image heating apparatus comprising:

a film having a tubular shape;

a backup member configured to be brought into contact with an outer surface of the film to form the nip portion;

a heater having an elongated shape, configured to be brought into contact with the film, the heater having an elongated shape, the heater including a substrate and a heat generating resistor formed on the substrate;

a plurality of first heat conductive members having a higher thermal conductivity than the substrate, the plurality of first heat conductive members configured to be brought into contact with a surface of the heater opposite to a surface of the heater that is brought into contact with the film, the plurality of first heat conductive members arranged in a longitudinal direction of the heater with a gap formed therebetween;

a support member configured to support the heater through the plurality of first heat conductive members, the support member pinching the plurality of first heat conductive members with the heater in a thickness direction of the heater; and a second heat conductive member provided in a region of the gap so as to be brought into contact with both of the heater and the support member, wherein the second heat conductive member comprises an elastic member.

7. The image heating apparatus according to claim 6, wherein, in the region of the gap, the second heat conductive member is provided to be brought into contact with the plurality of first heat conductive members arranged on both sides of the gap.

8. An image heating apparatus for heating a toner image formed on a recording material while conveying the recording material at a nip portion, the image heating apparatus comprising:

a film having a tubular shape;

a backup member configured to be brought into contact with an outer surface of the film to form the nip portion;

a heater having an elongated shape, configured to be brought into contact with the film, the heater having an elongated shape, the heater including a substrate and a heat generating resistor formed on the substrate;

a plurality of first heat conductive members having a higher thermal conductivity than the substrate, the plurality of first heat conductive members configured to be brought into contact with a surface of the heater opposite to a surface of the heater that is brought into contact with the film, the plurality of first heat conductive members arranged in a longitudinal direction of the heater with a gap formed therebetween;

a support member configured to support the heater through the plurality of first heat conductive members, the support member pinching the plurality of first heat conductive members with the heater in a thickness direction of the heater;

a second heat conductive member provided in a region of the gap so as to be brought into contact with both of the heater and the support member;

a cut-off member configured to be actuated in response to an abnormal temperature rise of the heater to interrupt power supplied to the heater, the cut-off member arranged to be brought into contact with one of the plurality of first heat conductive members; and a temperature detecting member configured, contacting another of the plurality of first heat conductive members, to detect a temperature of the heater via the other of first heat conductive members.

9. The image heating apparatus according to claim 8, wherein the cut-off member comprises a thermal fuse.

10. An image heating apparatus for heating a toner image formed on a recording material while conveying the recording material at a nip portion, the image heating apparatus comprising:

a film having a tubular shape;

a backup member configured to be brought into contact with an outer surface of the film to form the nip portion;

a heater having an elongated shape, configured to be brought into contact with the film, the heater including a substrate and a heat generating resistor formed on the substrate;

a plurality of heat conductive members having a higher thermal conductivity than the substrate, the plurality of heat conductive members configured to be brought into contact with a surface of the heater opposite to a surface of the heater that is brought into contact with the film, the plurality of the heat conductive members arranged in a longitudinal direction of the heater with a gap formed therebetween; and a support member configured to pinch the plurality of the heat conductive members with the heater in a thickness direction of the heater, wherein a lubricant is applied in a region of the gap so as to be brought into contact with both of two of the plurality of heat conductive members, which are opposed to each other across the gap.

11. The image heating apparatus according to claim 10, wherein the lubricant has an insulating property.

12. The image heating apparatus according to claim 10, wherein the plurality of first heat conductive members is provided across a passage region and a non-passage region of a small-sized recording material in the longitudinal direction of the heater.

13. The image heating apparatus according to claim 10, wherein the lubricant is a grease.

14. An image heating apparatus according for heating a toner image formed on a recording material while conveying the recording material at a nip portion, the image heating apparatus comprising:

a film having a tubular shape;

a backup member configured to be brought into contact with an outer surface of the film to form the nip portion;

a heater having an elongated shape, configured to be brought into contact with the film, the heater including a substrate and a heat generating resistor formed on the substrate;

a plurality of first heat conductive members, having a higher thermal conductivity than the substrate, the plurality of first heat conductive members configured to be brought into contact with a surface of the heater opposite to a surface of the heater that is brought into contact with the film, the plurality of first heat conductive members arranged in a longitudinal direction of the heater with a gap formed therebetween;

a support member configured to pinch the plurality of first heat conductive members with the heater in a thickness direction of the heater; and a second heat conductive member provided in a region of the gap so as to be brought into contact with both of two of the plurality of first heat conductive members, which are opposed to each other across the gap, wherein the second heat conductive member comprises an elastic member.

15. An image heating apparatus for heating a toner image formed on a recording material while conveying the recording material at a nip portion, the image heating apparatus comprising:

a film having a tubular shape;

a backup member configured to be brought into contact with an outer surface of the film to form the nip portion;

a heater having an elongated shape, configured to be brought into contact with the film, the heater including a substrate and a heat generating resistor formed on the substrate;

a plurality of first heat conductive members, having a higher thermal conductivity than the substrate, the plurality of first heat conductive members configured to be brought into contact with a surface of the heater opposite to a surface of the heater that is brought into contact with the film, the plurality of first heat conductive members arranged in a longitudinal direction of the heater with a gap formed therebetween;

a support member configured to pinch the plurality of first heat conductive members with the heater in a thickness direction of the heater;

a second heat conductive member provided in a region of the gap so as to be brought into contact with both of two of the plurality of first heat conductive members, which are opposed to each other across the gap;

a cut-off member configured to be actuated in response to an abnormal temperature rise of the heater to interrupt power supplied to the heater, the cut-off member being arranged to be brought into contact with one of the plurality of first heat conductive members; and a temperature detecting member contacting another of the plurality of first heat conductive members, the temperature detecting member configured to detect a temperature of the heater via the other of the plurality of first heat conductive members.

16. The image heating apparatus according to claim 15, wherein the cut-off member comprises a thermal fuse.

17. An image heating apparatus for heating a toner image formed on a recording material while conveying the recording material at a nip portion, the image heating apparatus comprising:

a film having a tubular shape;

a backup member configured to be brought into contact with an outer surface of the film to form the nip portion;

a heater having an elongated shape, configured to be brought into contact with the film, the heater including a substrate and a heat generating resistor formed on the substrate;

a plurality of first heat conductive members having a higher thermal conductivity than the substrate, the plurality of first heat conductive members configured to be brought into contact with a surface of the heater opposite to a surface of the heater that is brought into contact with the film, the plurality of first heat conductive members being arranged in a longitudinal direction of the heater with a gap formed therebetween;

a support member configured to support the heater through the plurality of first heat conductive members, the support member pinching the plurality of first heat conductive members with the heater in a thickness direction of the heater; and a second heat conductive member provided in a region of the gap so as to be brought into contact with both of the heater and the support member, wherein the second heat conductive member has an insulating property.

18. An image heating apparatus for heating a toner image formed on a recording material while conveying the recording material at a nip portion, the image heating apparatus comprising:

a film having a tubular shape;

a backup member configured to be brought into contact with an outer surface of the film to form the nip portion;

a heater having an elongated shape, configured to be brought into contact with the film, the heater including a substrate and a heat generating resistor formed on the substrate;

a plurality of first heat conductive members having a higher thermal conductivity than the substrate, the plurality of first heat conductive members configured to be brought into contact with a surface of the heater opposite to a surface of the heater that is brought into contact with the film, the plurality of first heat conductive members being arranged in a longitudinal direction of the heater with a gap formed therebetween;

a support member configured to pinch the plurality of first heat conductive members with the heater in a thickness direction of the heater; and a second heat conductive member provided in a region of the gap so as to be brought into contact with both of two of the plurality of first heat conductive members, which are opposed to each other across the gap, wherein the second heat conductive member has an insulating property.

* * * * *